US008501273B2

(12) United States Patent
Creech et al.

(10) Patent No.: US 8,501,273 B2
(45) Date of Patent: Aug. 6, 2013

(54) MIXTURE AND TECHNIQUE FOR COATING AN INTERNAL SURFACE OF AN ARTICLE

(75) Inventors: George Edward Creech, Indianapolis, IN (US); Randall Jay Cupp, Martinsville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 973 days.

(21) Appl. No.: 12/244,363

(22) Filed: Oct. 2, 2008

(65) Prior Publication Data

US 2010/0086680 A1 Apr. 8, 2010

(51) Int. Cl.
*B05D 7/22* (2006.01)

(52) U.S. Cl.
CPC ..... *B05D 7/22* (2013.01); *B05D 2202/00* (2013.01); *B05D 2259/00* (2013.01)
USPC ..... 427/237; 427/239; 427/253; 427/255.39

(58) Field of Classification Search
CPC ..... B05D 7/22; B05D 2202/00; B05D 2259/00
USPC ..... 427/230, 237, 239, 250, 252, 253, 427/255.28, 255.39, 299, 372.2, 383.1, 181, 427/201, 202
See application file for complete search history.

(56) References Cited

U.S. PATENT DOCUMENTS 3,859,061 A * 1/1975 Speirs et al. ..... 428/614
3,962,059 A 6/1976 Kaup et al.
4,031,274 A 6/1977 Bessen
4,132,816 A * 1/1979 Benden et al. ..... 427/237
4,148,275 A * 4/1979 Benden et al. ..... 118/715
4,347,267 A * 8/1982 Baldi ..... 427/237
4,501,766 A * 2/1985 Suzuki et al. ..... 427/580

(Continued)

FOREIGN PATENT DOCUMENTS

DE 102007050141 A1 4/2009
EP 1010774 A1 6/2000

(Continued)

OTHER PUBLICATIONS

Chen, "Slurry development for the deposition of a GdSiO4+Mullite environmental barrier coating on silicon carbide," Journal of Ceramic Processing Research, vol. 8, No. 2, pp. 142-144, 2007.

(Continued)

*Primary Examiner* — William Phillip Fletcher, III
(74) *Attorney, Agent, or Firm* — Shumaker & Sieffert, P.A.

(57) ABSTRACT

A mixture and technique for coating an internal surface of an article is generally described. In one aspect, a method includes introducing a mixture comprising an aluminum source and an organo halocarbon activator into an internal cavity of an article. In some embodiments, the method may further include heating the article and the mixture to a temperature sufficient to form an aluminum halide, which deposits on a surface of the internal cavity to form a coated article. In further embodiments, the method may also include depositing on an external surface of the article a first layer comprising Pt, Si, and a reactive element selected from the group consisting of Hf, Y, La, Ce, Zr, and combinations thereof, and depositing a second layer comprising Al on the first layer to form an alloy including a $\gamma$-Ni+$\gamma'$-$Ni_3Al$ phase constitution, where the second layer is deposited with the organo halocarbon activator.

36 Claims, 10 Drawing Sheets

U.S. PATENT DOCUMENTS

| | | | | | |
|---|---|---|---|---|---|
| 4,965,095 | A | * | 10/1990 | Baldi | 427/142 |
| 5,041,309 | A | * | 8/1991 | Davis et al. | 427/217 |
| 5,057,196 | A | | 10/1991 | Creech et al. | |
| 5,071,678 | A | | 12/1991 | Grybowski et al. | |
| 5,217,757 | A | * | 6/1993 | Olson et al. | 427/253 |
| 5,334,417 | A | | 8/1994 | Rafferty et al. | |
| 5,355,668 | A | | 10/1994 | Weil et al. | |
| 5,366,765 | A | * | 11/1994 | Milaniak et al. | 427/229 |
| 5,683,825 | A | | 11/1997 | Bruce et al. | |
| 5,807,428 | A | | 9/1998 | Bose et al. | |
| 5,824,366 | A | | 10/1998 | Bose et al. | |
| 5,958,204 | A | | 9/1999 | Creech et al. | |
| 5,976,337 | A | | 11/1999 | Korinko et al. | |
| 5,997,604 | A | | 12/1999 | Rafferty et al. | |
| 6,045,863 | A | | 4/2000 | Olson et al. | |
| 6,110,262 | A | * | 8/2000 | Kircher et al. | 106/14.44 |
| 6,180,170 | B1 | * | 1/2001 | Grossmann et al. | 427/237 |
| 6,273,678 | B1 | * | 8/2001 | Darolia | 415/200 |
| 6,294,261 | B1 | | 9/2001 | Sangeeta et al. | |
| 6,332,926 | B1 | | 12/2001 | Pfaendtner et al. | |
| 6,406,561 | B1 | | 6/2002 | Creech et al. | |
| 6,485,848 | B1 | | 11/2002 | Wang et al. | |
| 6,497,920 | B1 | * | 12/2002 | Weimer et al. | 427/235 |
| 6,533,875 | B1 | * | 3/2003 | Pfaendtner et al. | 148/535 |
| 6,586,052 | B2 | | 7/2003 | Creech et al. | |
| 6,613,445 | B2 | | 9/2003 | Sangeeta et al. | |
| 6,616,969 | B2 | * | 9/2003 | Pfaendtner et al. | 427/237 |
| 6,730,179 | B2 | * | 5/2004 | Kircher | 148/240 |
| 6,989,174 | B2 | * | 1/2006 | Heng et al. | 427/237 |
| 7,056,555 | B2 | | 6/2006 | Bauer et al. | |
| 8,273,231 | B2 | * | 9/2012 | Creech | 204/484 |
| 2003/0044536 | A1 | | 3/2003 | Rigney et al. | |
| 2003/0211242 | A1 | * | 11/2003 | Shah | 427/237 |
| 2004/0229075 | A1 | | 11/2004 | Gleeson et al. | |
| 2006/0127695 | A1 | | 6/2006 | Gleeson et al. | |
| 2009/0162684 | A1 | | 6/2009 | Creech | |
| 2010/0255260 | A1 | | 10/2010 | Lee et al. | |

FOREIGN PATENT DOCUMENTS

| | | | |
|---|---|---|---|
| EP | 1088908 | A2 | 4/2001 |
| EP | 1609885 | A1 | 12/2005 |
| EP | 1462537 | A2 | 4/2008 |
| EP | 1978210 | A1 | 10/2008 |
| WO | 0105579 | A2 | 1/2001 |
| WO | 2009/085188 | A1 | 7/2009 |

OTHER PUBLICATIONS

U.S. Appl. No. 12/750,971, filed Mar. 31, 2010.

Canadian Office Action from Canadian patent application No. 2,681,000, dated May 27, 2010, 5 pp.

Official Action issued by the Canadian Inteiiectual Property Office for corresponding Canadian patent application no. 2,681,000. dated Jul. 18, 2011, 2 pp.

Office Action from the Intellectual Property Office of Singapore (IPOS) with Invitation to Respond to the Search Report and Written Opinion from the Hungarian Patent and Trademark Office for corresponding Singapore application No. 200906656-4, dated Aug. 19, 2010, 19 pp.

Examination Report from Singapore application No. 200906656-4, mailed May 3, 2011, 8 pp.

Final Office Action for U.S. Appl. No. 11/963,249, dated Dec. 12, 2011, 21 pages.

Response to Final Office Action for U.S. Appl. No. 11/963,249, filed Mar. 12, 2012, 10 pages.

Response to Office Action dated Jul. 31, 2012, from U.S. Appl. No. 12/750,971, filed Oct. 31, 2012, 10 pp.

Office Action from corresponding Canadian application No. 2,681,000, dated Aug. 16, 2012, 3 pp.

Response to Final Office Action dated Nov. 15, 2012, from U.S. Appl. No. 121750,971, filed Jan. 15, 2013, 11 pp.

Office Action from U.S. Appl. No. 12/750,971, dated Nov. 15, 2012, 10 pp.

Office Action from U.S. Appl. No. 12/750,971, dated Jul. 31, 2012, 10 pp.

* cited by examiner

MIXTURE AND TECHNIQUE FOR COATING AN INTERNAL SURFACE OF AN ARTICLE

TECHNICAL FIELD

The present disclosure generally relates to techniques for coating an internal surface of an article.

BACKGROUND

Nickel- and/or cobalt-based superalloys effective for use in high temperature environments are commonly used by the aerospace and power industries. While such alloys are inherently strong, they are generally not particularly resistant to corrosion by high temperature gases. Corrosion and oxidation-resistant coatings are therefore often applied to the superalloys to improve corrosion and/or oxidation resistance.

Internal coatings to protect those superalloy parts can be applied by several different methods. For example, chemical vapor deposition (CVD) methods using a reactor to generate a reactive Al-bearing species, or CVD methods that use above-the-pack technology, have been used. Both methods are generally effective, but require a sizable investment in equipment and the like. Moreover, in the case of above-the-pack processes, there is a significant amount of waste generated, including corrosive gases that require scrubbers to capture active species and/or convert them to innocuous products.

SUMMARY

In general, the disclosure is directed to a mixture and techniques for coating an internal cavity of an article. In some embodiments, the article may include a turbine vane or turbine blade, and may be formed of a superalloy substrate comprising Ni or Co. The article may include one or more cavities, which may or may not be interconnected. The coating techniques may generally include introducing a mixture into a cavity of the article and heating the article and cavity. The mixture may be in dry powder form, or may be a slurry or suspension in a liquid carrier, and may include an aluminum source and an organo halocarbon activator. When heated, the organo halocarbon activator may decompose and release a halogen species, which reacts with aluminum in the aluminum source to form an aluminum halide. The aluminum halide may then diffuse to a surface of the cavity, where the aluminum reacts with and is deposited on the surface.

In one aspect, the present disclosure is directed to a method including introducing a mixture comprising an aluminum source and an organo halocarbon activator into an internal cavity of an article, and heating the article and the mixture to a temperature sufficient to form an aluminum halide, which deposits on a surface of the internal cavity to form a coated article.

In another aspect, the present disclosure is directed to a method including depositing on an external surface of an article a first layer comprising Pt, Si, and a reactive element selected from the group consisting of Hf, Y, La, Ce, Zr, and combinations thereof, introducing a mixture comprising aluminum and an organo halocarbon activator into an internal cavity of the article, and depositing a second layer comprising Al on the first layer to form an alloy including a $\gamma$-Ni+$\gamma'$-$Ni_3Al$ phase constitution, where the second layer is deposited with the organo halocarbon activator.

The details of one or more embodiments of the invention are set forth in the accompanying drawings and the description below. Other features, objects, and advantages of the invention will be apparent from the description and drawings, and from the claims.

DETAILED DESCRIPTION

In one aspect, the present disclosure is generally directed to techniques for depositing a coating on a surface of a cavity of an article. The coating may be an aluminide coating and may be deposited with an organo halocarbon activator. In some embodiments, the coating on the surface of the cavity of the article may be applied substantially concurrently with application of a coating to an external surface of the article.

The coating may be applied to any article, and may be particularly well suited for application on superalloy articles including Ni and Co. An article including any conventional superalloy may be used, including, for example, those available from Martin-Marietta Corp., Bethesda, Md., under the trade designation MAR-M247; those available from Cannon-Muskegon Corp., Muskegon, Mich., under the trade designation CMSX-4, CMSX-10; and the like. Typical superalloy constituents such as, for example, Cr, Co, Mo, Ta, Ti, W, Re, and combinations thereof, may optionally be added to or present in the alloy composition. In some embodiments, the article may be component of a high temperature mechanical system, such as, for example, a turbine blade or turbine vane that is used in a gas turbine engine.

Figure 1A:
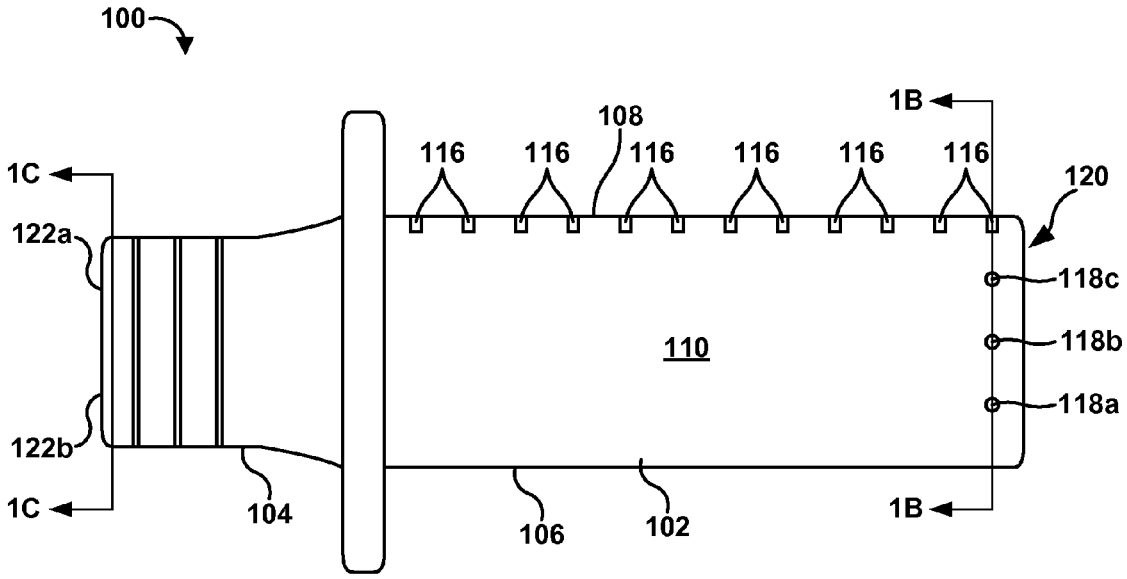
FIGS. 1A-1C depict various views of an example turbine blade, which includes a plurality of cavities.
Figure 1B:
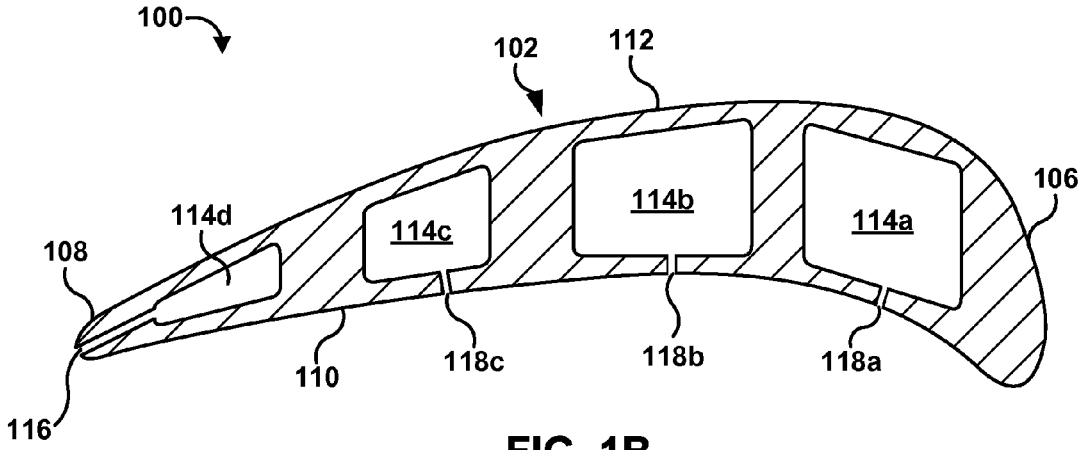
Figure 1C:
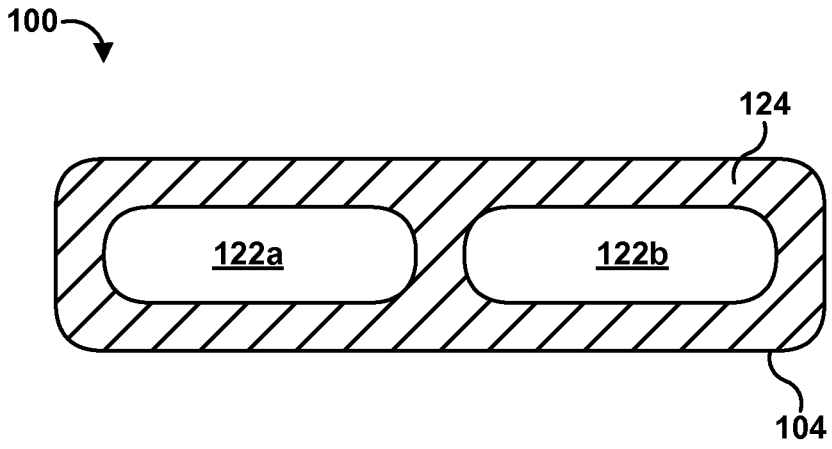

FIGS. 1A-1C illustrate various views of an example turbine blade 100 on which a coating may be deposited according to the techniques of the present disclosure. Turbine blade 100 generally includes an airfoil 102 attached to a stalk 104. Airfoil 102 includes a leading edge 106, a trailing edge 108, a pressure sidewall 110 and a suction sidewall 112. Pressure sidewall 110 is connected to suction sidewall 112 at trailing edge 108 and leading edge 106.

In the embodiment illustrated in FIGS. 1A-1C, turbine blade 100 also includes a first cavity 114*a*, second cavity 114*b*, third cavity 114*c* and fourth cavity 114*d* (collectively "cavities 114"). Cavities 114 may aid in cooling turbine blade 100 during operation of blade 100 by circulating relatively cool air through the interior of blade 100. In some embodiments, one or more of cavities 114 is in fluid communication with at least another one of cavities 114. In some embodiments, blade 100 may include more than four cavities 114 or fewer than four cavities 114.

Turbine blade 100, and more specifically airfoil 102, may also include a plurality of trailing edge exit slots 116. As is best seen in FIG. 1B, at least one of trailing edge exit slots 116 is fluidly connected to fourth cavity 114*d*. Trailing edge exit slots 116 provide an exit for the relatively cool air that flows through fourth cavity 114*d*.

Airfoil 102 further includes a plurality of film cooling holes 118. First film cooling hole 118*a* is in fluid communication with first cavity 114*a*, while second film cooling hole 118*b* and third film cooling hole 118*c* are in fluid communication with second cavity 114*b* and third cavity 114*c*, respectively. The plurality of film cooling holes 118 may be located proximate tip 120 of blade 100, as shown in FIG. 1A. In other embodiments, the plurality of film cooling holes 118 may be arrayed throughout at least a portion of the length of airfoil 102. In some embodiments, airfoil 102 may include more than three film cooling holes 118. In yet other embodiments, the film cooling holes 118 may be located on tip 120 of blade 100.

FIG. 1C illustrates a cross-sectional view of stalk 104 of blade 100. As shown in FIG. 1C, stalk 104 may include a first metering plate orifice 122*a* and a second metering plate orifice 122*b* (collectively "metering plate orifices 122") defined in a bottom surface 124 of stalk 104. Metering plate orifices 122 fluidly connect to one or more of cavities 114 and provide an inlet for the relatively cool air that flows through cavities 114 and out of trailing edge exit holes 116 and film cooling holes 118. In some embodiments, stalk 104 may include a single metering plate orifice 122 or more than two metering plate orifices 122.

As described briefly above, turbine blade 100 may be a component of a high temperature mechanical system, such as a gas turbine engine. When used in a high temperature mechanical system, blade 100 may experience high temperatures and may be prone to corrosion or oxidation. Thus, turbine blade 100 may include a protective coating that reduces or substantially eliminates the effects of oxidation or corrosion on blade 100. For example, leading edge 106, trailing edge 108, pressure sidewall 110 and suction sidewall 112 may be coated with a thermal barrier coating (TBC), which is a porous ceramic coating that provides thermal insulation for exterior surfaces of blade 100. The TBC may be attached to blade 100 by a bond coat, which in some embodiments may be a coating including a $\gamma$-Ni+$\gamma'$-$Ni_3Al$ phase constitution. In the present application, a $\gamma$-Ni+$\gamma'$-$Ni_3Al$ coating refers to a coating that includes a Pt-group metal, Ni and Al in relative concentration such that a $\gamma$-Ni+$\gamma'$-$Ni_3Al$ phase constitution results in some portion of the coating. In some embodiments, the concentration of Al is limited with respect to the concentration of Ni and the Pt-group metal such that substantially no $\beta$-NiAl phase structure, preferably no $\beta$-NiAl phase structure, is present in the alloy, and the $\gamma$-Ni+$\gamma'$-$Ni_3Al$ phase constitution predominates. Exemplary alloys and coatings with a $\gamma$-Ni+$\gamma'$-$Ni_3Al$ phase constitution are described in, for example, U.S. Pat. No. 7,273,662, which is incorporated by reference herein in its entirety.

While external coatings including a $\gamma$-Ni+$\gamma'$-$Ni_3Al$ phase constitution are generally preferred, the methods described herein may be used to make external coatings including up to about 33 at. % Al, which results in a coating having a substantially $\beta$-NiAl phase structure. Thus, while this disclosure is directed in part to producing external coatings having a $\gamma$-Ni+$\gamma'$-$Ni_3Al$ phase constitution, the invention is not limited to such coatings.

Cavities 114 may also require protection from oxidation and/or corrosion. In many embodiments, the surfaces of cavities 114 may not receive a TBC, and may instead receive a protective aluminide coating, which oxidizes to form an aluminum oxide coating that resists further oxidation or corrosion. As described in further detail hereinafter, the aluminide coating may be applied to the surface of cavities 114 by introducing a mixture including an aluminum source, an organo halocarbon activator and, optionally, filler into the cavities 114 and heating blade 100 and the mixture. In some embodiments, the mixture may be in dry powder form, while in other embodiments, a liquid carrier may carry the mixture in a suspension or slurry.

Figure 2:
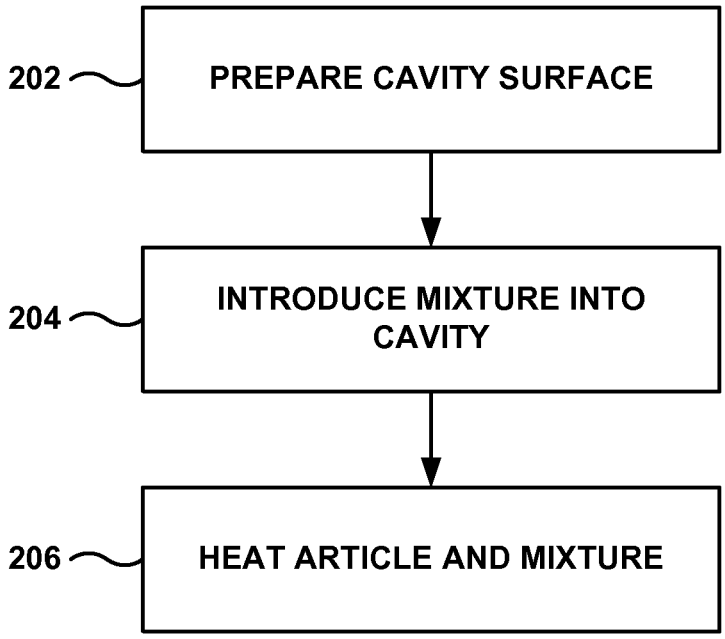
FIG. 2 is a flow diagram that depicts an example technique for depositing a coating on a surface of an internal cavity of an article.

FIG. 2 is a flow diagram illustrating an example technique of depositing a coating on a surface of an internal cavity of an article. While FIG. 2 will be described with reference to turbine blade 100, it will be understood that the disclosure is not thus limited, and that the technique described in FIG. 2 may be used to deposit a coating on an interior surface of other articles. Initially and optionally, the surface of the internal cavity may be prepared (202). Preparation of the surface may include mechanical or chemical preparation. For example, in some embodiments, a solution of about 50% nitric acid and 50% water may be applied to the surface to remove any oxide layer that has formed on the surface of cavities 114. Alternatively, the surface of the internal cavity may be cleaned by fluoride ion cleaning (FIC), which may reduce any oxide film present on the surface of cavities 114.

The technique further includes introducing a mixture into the cavities 114 of the article (204). The mixture may include an aluminum source, an organo halocarbon activator and, optionally, a filler. In some embodiments, the mixture may be in powder form, while in other embodiments, the mixture may be carried in a liquid carrier.

The aluminum source may include elemental Al, or may include alloy powders such as, for example, (by weight) 55Al:45Cr, 42Al:40Cr:18Mn, 10Al:30Cr, other aluminum-chromium alloys, organo-aluminum compounds, and the like.

The organo halocarbon activator may act as an activator for the aluminum during a subsequent heat treatment step. The organo halocarbon may include, for example, fluoropolymers, choropolymers, and the like.

The organo halocarbons are preferably compatible with the liquid carrier in the suspension and can preferably be produced in granular form. One preferred fluoropolymer is polytetrafluoroethylene (PTFE), which may be obtained from DuPont Fluoroproducts, Wilmington, Del., under the trade designations DuPont Teflon PTFE 60 and DuPont Zonyl MP-1200, which is a micronized PTFE powder.

The mixture may also include filler. The filler may be a non-reactive oxide powder, such as aluminum oxide, zirconium oxide, titanium oxide, hafnium oxide, and the like. The size of the filler particles may vary, and may affect the ease with which the mixture infiltrates the cavity of the article. The size of the filler particles may also influence the ease with which any residual mixture is removed from cavities 114 after completion of the coating technique. For example, relatively larger filler particles may facilitate removal of the residual mixture from cavities 114, while relatively smaller filler particles may make removal of the residual mixtures from cavities 114 more difficult. On the other hand, relatively smaller filler particles may improve the ease with which the mixture infiltrates cavities 114 of blade 100 compared to relatively larger filler particles, such as, for example, when the cavities 114 include portions having a small diameter, serpentine path, or other restrictions. For example, an average size of the filler particles may range from about 1 micron (14,000 grit) to about 160 microns (90 grit). Other suitable filler particles sizes may include about 135 microns (120 grit), about 115 microns (150 grit), and about 90 microns (220 grit).

When the mixture is carried in a liquid carrier, such as in a suspension or slurry, the liquid carrier may vary widely so long as it is compatible with the solids therein. In some embodiments, an organic solvent or mixture of organic solvents may be used. In addition, the liquid carrier may be essentially anhydrous, i.e., may be essentially free of water. Preferred liquid carriers also have at least one of a high specific gravity and a high dielectric constant. The liquid carrier may dissolve an electrophoretically active agent, which is described below, up to a concentration of about 5 g/L. Additionally, it may be preferred that the liquid carrier does not react with an activating agent, such as those described in further detail below.

Example liquid carriers may include, for example, nitroalkanes, alcohols containing about 1 to about 6 backbone carbons, glycols, and the like. In some embodiments, the liquid carrier may include a mixture of isopropanol and nitromethane in a ratio from about 55 wt. % isopropanol and 45 wt. % nitromethane to about 65 wt. % isopropanol and about 35 wt. % nitromethane. One exemplary liquid carrier may include about 60 wt. % isopropanol and about 40 wt. % nitromethane.

When the mixture is carried in a liquid carrier, the suspension or slurry may also include an electrophoretically active agent such as zein, gliadin, synthetic methyl cellulose, and the like. The electrophoretically active agent, in conjunction with an activating agent, may form a chelated complex, which has a positive charge, with the aluminum source in the suspension. When present in the suspension or slurry, the electrophoretically active agent may be present at a concentration of about 1 g/L to about 30 g/L. In some embodiments, the electrophoretically active agent may be present at a concentration of about 1 g/L to about 3 g/L, and the electrophoretically active agent may be present in the mixture at a concentration of about 2.2 g/L.

The suspension or slurry may further include an activating agent. In some embodiments, the activating agent may include a transition metal nitrate having a divalent (+2) charge that can form a chelated complex with the electrophoretically active agent. In some embodiments, preferred activating agents include nickel nitrate hexahydrate, cobalt nitrate hexahydrate, and the like. When present in the suspension or slurry, the activating agent may be present at a concentration of about 0.08 g/L to about 0.20 g/L, and in some embodiments, may be present at a concentration of about 0.14 g/L.

When the mixture is carried in a liquid carrier, the suspension or slurry may include any total solids content that provides a slurry or suspension of a desired consistency (e.g., a consistency that allows the slurry or suspension to be injected into the cavity). For example, the mixture may include a total solids content of about 15 g solids per L liquid carrier to about 2000 g solids per L liquid carrier. In some embodiments, about 100 g solids may be mixed with 0.050 L of a zein solution to form a slurry.

Typically, the powder mixture, or the solids in the suspension or slurry, may include about 0.5 wt. % to about 25 wt. % of the Al source, about 1 wt. % to about 10 wt. % of the organo halocarbon activator, and the balance filler. In some embodiments, the powder mixture, or the solids in the slurry or suspension, may include about 1 wt. % to about 6 wt. % of the Al source, about 1 wt. % to about 10 wt. % of the organo halocarbon activator, and the balance filler. By adjusting the composition of the powder mixture or solids in the suspension or slurry, the thickness of the resulting coating on the surface of cavities 114 may be controlled. For example, higher aluminum source content may result in a thicker coating on the surface of cavities 114, while lower aluminum source content may result in a thinner coating on the surface of cavities 114.

Once the mixture is introduced into the cavities 114 of turbine blade 100, blade 100 and the mixture are heated (206). While not wishing to be bound by any theory, presently available evidence indicates that the heating may cause the organo halocarbon activator to decompose and release a halogen species. The halogen species may react with aluminum in the aluminum source to form an aluminum halide, thus activating the aluminum. The aluminum halide may the diffuse to the surface of cavities 114, and the aluminum may react with and be bound to the surface. The reaction of the aluminum with the surface of cavities 114 liberates the halogen, which may then react with and activate another aluminum atom in the aluminum source. Thus, the heat treatment step can bind the aluminum to the surface of cavities 114. Further, heating blade 100 and the mixture may allow aluminum to diffuse into the surface of cavities 114.

At least some of the aluminum halides formed by the reaction of the halogen species with aluminum in the aluminum source may be present in a vapor phase. This may facilitate more uniform coating of the surface of cavities 114. For example, cavities 114 may include portions which have a small diameter, are serpentine or otherwise restricted, and which do not come in intimate contact with the mixture, in powder, slurry, or suspension form. In conventional processes, this may lead to reduced coating thicknesses in these portions, or even no coating in these portions. However, in techniques according to the present disclosure, the formation of vapor phase aluminum halides allows aluminum to be deposited on surfaces of cavities 114 that are not contacted with the powder, slurry or suspension mixture. Accordingly, coatings formed by the techniques of the current disclosure may be deposited on portions of the surface of cavities 114 on which conventional techniques do not deposit a coating. Additionally, coatings formed by the techniques of the current disclosure may have a more uniform thickness than coatings formed by conventional techniques.

By selecting the heating time and heating temperature of turbine blade 100 and the mixture, the total amount of Al bound to the surface of cavities 114 can be controlled. In some embodiments, turbine blade 100 and the mixture may be heated to about 1400° F. to about 1975° F. for about 1 hour to about 4 hours activate the organo halocarbon activator and deposit the aluminum on the surface of cavities 114. In some embodiments, the heat treatment may be carried out in an oven under an inert atmosphere, such as a partial pressure (e.g., about −5 inches Hg) of argon.

In some embodiments, the aluminum coating is further heat treated to diffuse the aluminum into the surface of cavities 114, as will be described in further detail below with respect to FIG. 5. Additionally, in some embodiments, cavities 114 are cleaned after this further heat treatment by, for example, a high pressure water blast. The resulting coating may include a composition that results in a β-NiAl phase constitution.

Figure 3:
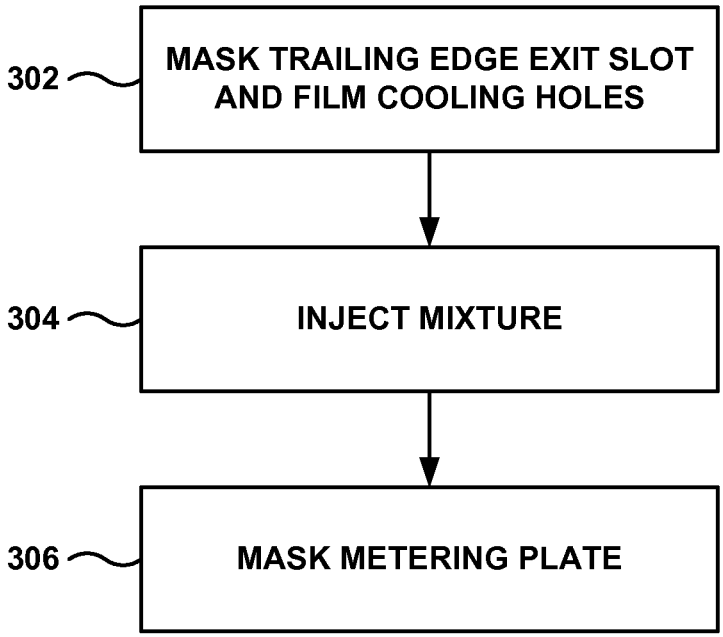
FIG. 3 is a flow diagram that depicts an example technique for introducing a mixture into a cavity.
Figure 4A:
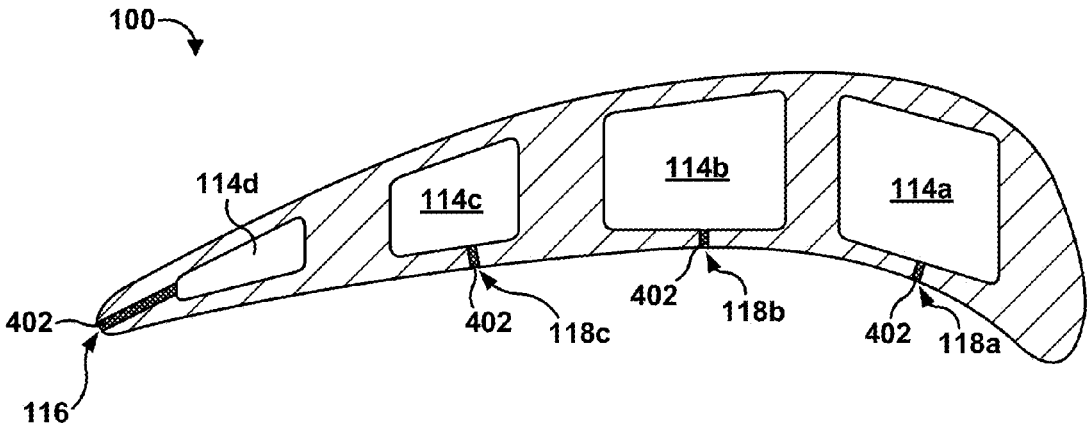
FIGS. 4A and 4B are cross-sectional views of an example turbine blade.

FIG. 3 is a flow diagram illustrating further detail of an example technique for introducing a mixture into a cavity of an article, step (204) shown in FIG. 2. In particular, the technique illustrated in FIG. 3 describes the introduction of the mixture into one or more cavities in a turbine blade or turbine vane. The flow diagram of FIG. 3 will be described with further reference to the cross-sectional views of turbine blade 100 illustrated in FIGS. 4A and 4B. First, one or more of trailing edge exit slots 116 and/or one or more of the plurality of film cooling holes 118 may be masked with a masking material 402 (302). In some embodiments, all of the film cooling holes 118 and trailing edge exit slots 116 may be masked with masking material 402. Masking of the exit slots 116 and film cooling holes 118 prevents a mixture 404 (FIG. 4B) from exiting exits slots 116 and film cooling holes 118 when mixture 404 is introduced into cavities 114.

Masking of at least some of trailing edge exits slots 116 and/or film cooling holes 118 may also prevent the aluminum halide vapor formed by the reaction of the aluminum in the aluminum source and the organo halocarbon activator from escaping cavities 114 when mixture 404 and blade 100 are heated (e.g., step 106 of FIG. 1). This may prevent loss of aluminum to the external environment, and may also prevent aluminum from being deposited on areas of turbine blade 100 where aluminum deposition is not desired, such as, for example, the stalk 104 of blade 100 (see FIG. 1).

In some embodiments, masking material 402 may include a thermal or UV curable resin. For example, Testors cement (available from The Testors Corporation, Rockford, Ill.), Dymax 706-H (available from Dymax Corporation, Torrington, Conn.) or a RTV (Room Temperature Vulcanizing) rubber may be applied to at least some of trailing edge exit slots 116 and/or film cooling holes 118 and cured using thermal or UV energy.

In some embodiments, it may be desired that the masked areas also receive some form of aluminum or aluminide coating. In embodiments such as these, masking material 402 may be mixed with an aluminum source. The aluminum source may include, for example, elemental Al, or may include alloy powders such as, for example, (by weight) 55Al:45Cr, 42Al:40Cr:18Mn, 10Al:30Cr, other aluminum-chromium alloys, organo-aluminum compounds, and the like. The aluminum source may be mixed into a slurry including masking material 402, applied to at least some of trailing edge exit slots 116 and/or film cooling holes 118, and cured. When heated, the aluminum from the aluminum source may diffuse to the surface of the masked areas and be deposited on the surface, forming a coating. Further details regarding mixing masking material 402 with an aluminum source may be found in U.S. Pat. No. 6,586,052, the contents of which are incorporated herein by reference in their entirety.

Masking material 402 may be applied to at least some of trailing edge exit slots 116 and/or film cooling holes 118, and the surfaces of turbine blade 100 adjacent trailing edge exit slots 116 and/or film cooling holes 118 may be cleaned to remove any excess masking material 402. Masking material 402 may then be cured using heat or UV radiation, and the surfaces of turbine blade 100 adjacent the cured masking material 402 may be cleaned with a light grit blasting following the cure. The grit blasting may be performed using aluminum oxide or another abrasive.

Figure 4B:
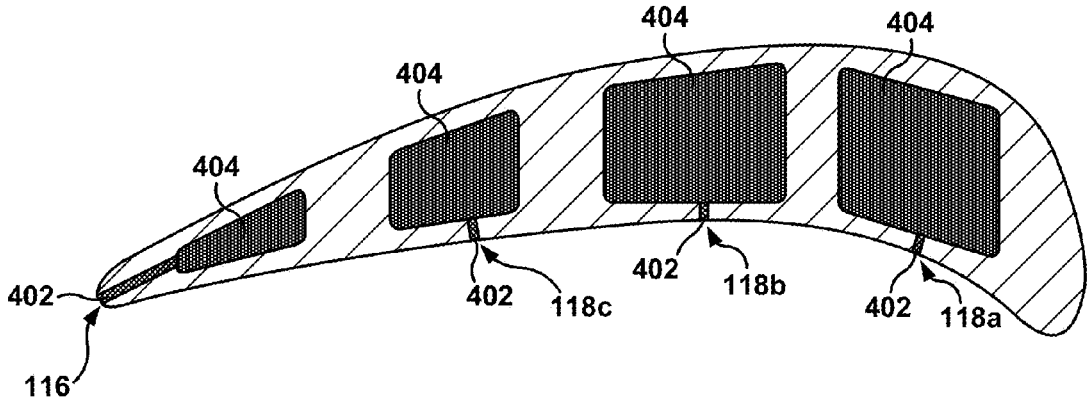

Once at least some of trailing edge exit slots 116 and/or film cooling holes 118 have been masked, a mixture 404 is injected into the cavities 114 (304), as illustrated in FIG. 4B. As described above, mixture 404 may include an aluminum source, organo halocarbon activator and filler in dry powder form or in a liquid carrier. Mixture 404 may be injected into cavities 114 via metering plate orifices 122 until cavities 114 are substantially filled. For example, mixture 404 may be injected into cavities 114 and blade 100 shaken or otherwise agitated to facilitate the introduction of mixture 404 into any restricted portions of cavities 114, such as, for example, serpentine portions of one or more of cavities 114, narrow portions of one or more of cavities 114, or the like.

When mixture 404 is carried in a liquid carrier as a suspension or slurry, cavities 114 may be only partially filled with the suspension or slurry and the blade 100 may be rotated or agitated to coat the surfaces of cavities 114. The excess suspension or slurry may then be allowed to run out metering plate orifices 122. This may reduce the amount of mixture 404 required to form the coating on the surfaces of cavities 114. In other embodiments, cavities 114 may be substantially filled with mixture 404 when mixture 404 is carried in a liquid carrier.

Once mixture 404 has been introduced into cavities 114, metering plate orifices 122 are masked with masking material 402 (306). Similar to masking at least some of trailing edge exit slots 116 and/or film cooling holes 118, masking metering plate orifices 122 may prevent the aluminum halide vapor formed by the reaction of the aluminum in the aluminum source and the organo halocarbon activator from escaping cavities 114 when mixture 404 and blade 100 are heated (e.g., step 106 of FIG. 1). This may prevent loss of aluminum to the external environment, and may also prevent aluminum from being deposited on areas of turbine blade 100 where aluminum deposition is not desired, such as, for example, stalk 104 of blade 100 (see FIG. 1).

In some embodiments, masking material 402 may include a thermal or UV curable resin. For example, Testors cement (available from The Testors Corporation, Rockford, Ill.) or Dymax 706-H (available from Dymax Corporation, Torrington, Conn.) may be used to mask metering plate orifices 122 and be cured using thermal energy, UV energy, or a combination of thermal energy and UV energy. In some embodiments, the same masking material 402 is used to mask trailing edge exit slots 116, film cooling holes 118 and metering plate orifices 122, while in other embodiments, a different masking material 402 is used to mask metering plate orifices 122 than is used to mask trailing edge exit slots 116 and film cooling holes 118.

Once metering plate orifices 122 are masked, turbine blade 100 and mixture 404 are heated, as described above with reference to step 206 of FIG. 2.

Figure 5:
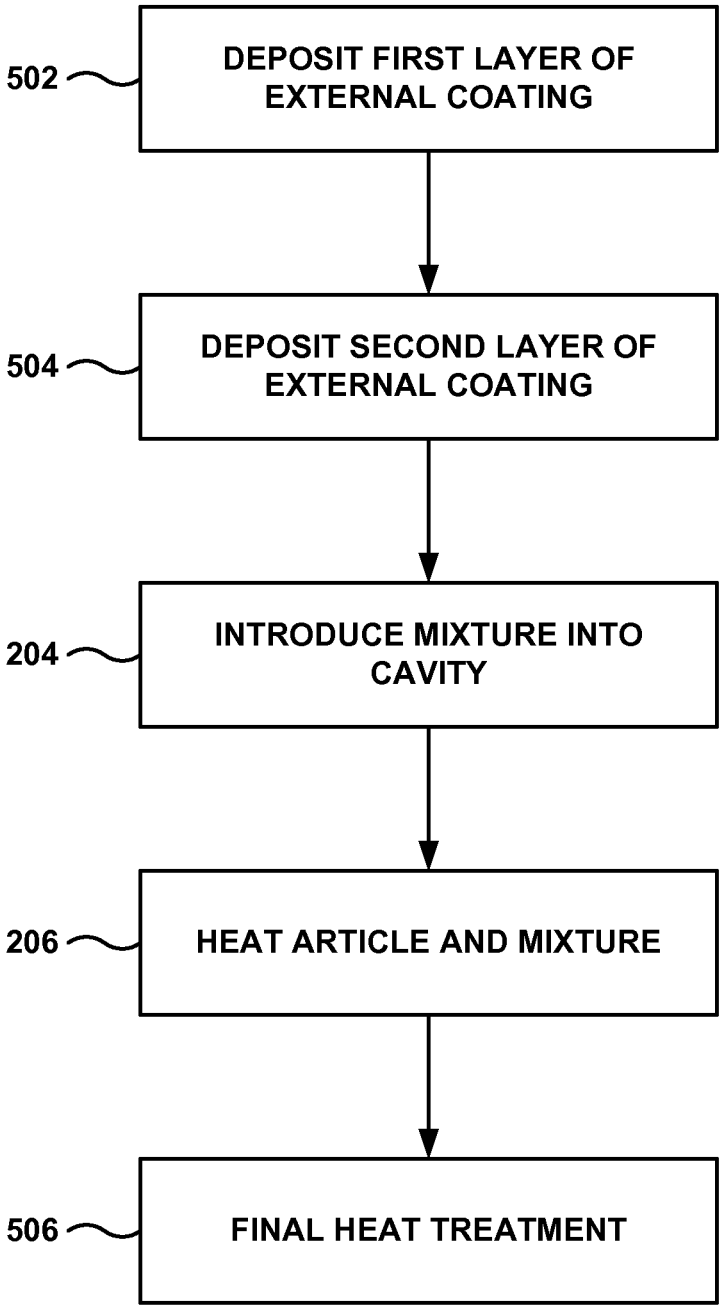
FIG. 5 is a flow diagram illustrating an example technique for depositing a coating on an external surface of an article and depositing a coating on a surface of an internal cavity of the article.

FIG. 5 is a flow diagram illustrating an overview of an exemplary technique of depositing an internal coating to a surface of a cavity of a turbine blade and an external coating to an exterior surface of the blade, which will be discussed with further reference to FIGS. 6-9. While the technique is described with reference to a turbine blade, the technique may also be used to deposit a coating on a surface of a cavity of another article, including, but not limited to, a turbine vane. Prior to performing the steps of the technique illustrated in FIG. 5, the surface of cavities 614 and/or the exterior surface of turbine blade 602 may optionally be prepared, similar to step (202) described with reference to FIG. 2. Following the optional surface preparation, a first layer 616 of an external coating may be deposited on at least a portion of the external surface of blade 602 (502). In some embodiments, the first layer may include Si, a Pt-group metal, and at least one reactive element such as, for example, Hf, Y, La, Ce, Zr and combinations thereof. Any suitable coating method may be used to apply the first layer, including, for example, electrophoretic deposition.

Figure 6:
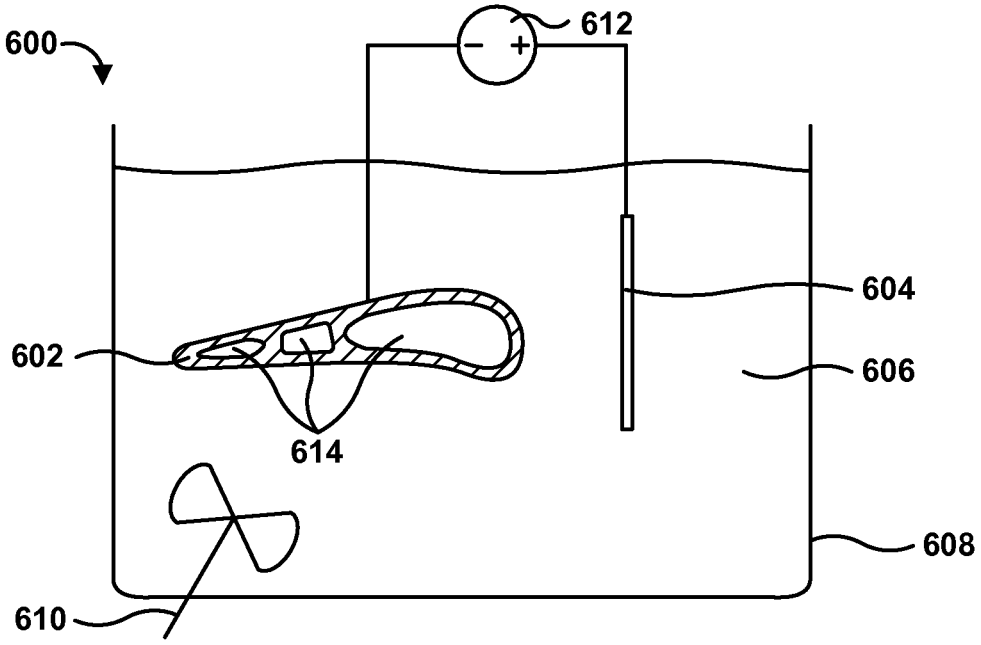
FIG. 6 is a side view illustrating an example article immersed in an electrophoretic bath.
Figure 7:
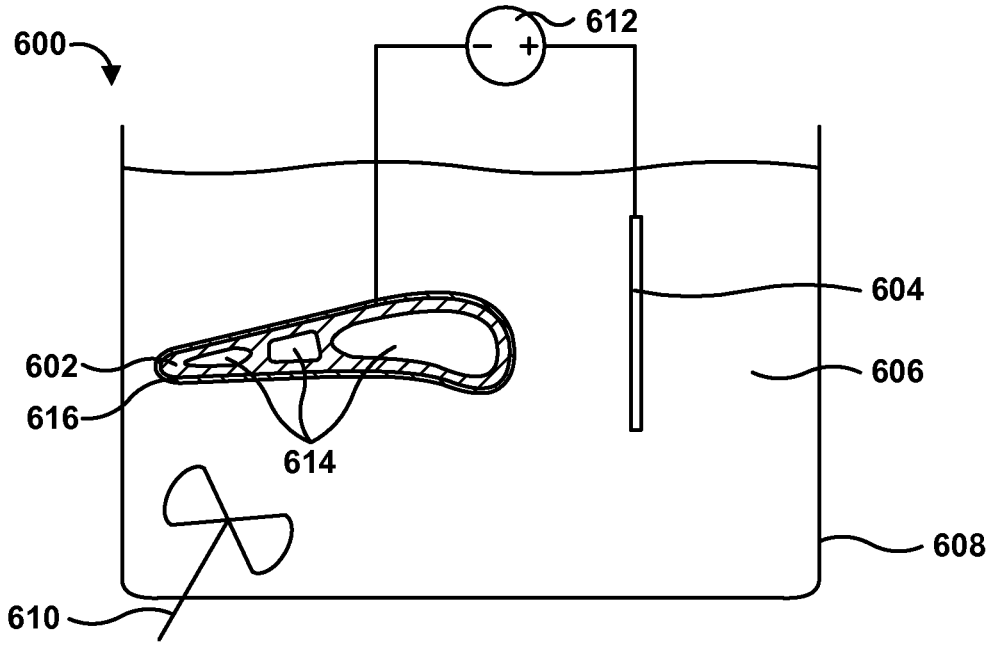
FIG. 7 is a side view illustrating an example article immersed in an electrophoretic bath and coated with a layer including a Pt-group metal, a reactive element, and Si.

FIG. 6 is a block diagram illustrating a simplified exemplary electrophoresis bath apparatus 600, which may be used to apply a first layer 616 of the external coating to turbine blade 602. In an electrophoretic coating process, turbine blade 602, which includes a plurality of cavities 614 is electrically coupled to a DC voltage source 612 as a cathode and submerged in an electrophoretic bath 608. Electrophoretic bath 608 may include a suspension 606 of solids (including the constituents of the first layer of the external coating and any activator) and any other desired additives, such as surfactants, oxidizers, and the like, in a liquid carrier. In some embodiments, an impeller 610 or other suitable agitator may agitate the suspension 606 to keep the solids and additives suspended in the liquid carrier. Electrophoresis bath apparatus 600 also includes a suitable conductive material 604 electrically coupled to DC voltage source 612 as an anode and submerged in bath 608. A DC voltage is applied between turbine blade 602 and conductive material 604, causing a current to flow, which causes the positively charged coating constituents, which may be present in suspension 606 as a metal/zein ($Co^{++}$) complex species, to be attracted to the cathode, where they contact turbine blade 602, are deposited on the exterior surface of turbine blade 602, and are bonded onto the surface of turbine blade 602 in a first layer 616, as shown in FIG. 7.

The solids in suspension 606 may include a Pt-group metal such as, for example, Pt, Pd, Ir, Rh, Ru, and combinations thereof. The solids in suspension 606 may further include at least one reactive element such as, for example, Hf, Y, La, Ce, Zr and combinations thereof. In some embodiments, the Pt-group metal may include Pt and the reactive element may include Hf. The addition of such reactive elements tends to stabilize the γ' phase in the final external coating composition. Therefore, if sufficient reactive metal is incorporated into the external coating composition, the resulting phase constitution may be predominately γ', or solely γ'. In addition, the solids in the suspension 606 may also include Si.

In some embodiments, the solids may be prepared by forming an alloy including the Pt-group metal, reactive element, and Si. The alloy may then be ground into a powder and deposited in the suspension 606. The alloying and subsequent grinding may result in an alloy powder having a substantially homogeneous composition of Pt-group metal, reactive element, and Si.

Grinding may result in an alloyed powder that includes particles with a size distribution. That is, not all particles in the alloyed powder are necessarily the same size (e.g., diameter). The alloyed powder may include a relatively wide range of particle sizes, depending on the parameters of the electrophoretic deposition process. In certain embodiments, the size of a majority of particles in the alloyed powder may range from about 1 μm to about 20 μm, and more preferably from about 5 μm to about 10 μm. Grinding may also introduce small amounts of impurities into the alloyed powder, which may include, for example, Al and O, primarily in the form of $Al_2O_3$.

The alloyed powder is preferably substantially free of impurities, but may include up to about 5 wt. % impurities. The alloyed powder also preferably includes less than about 3 wt. % $O_2$. If oxygen impurities combine with the reactive element in the alloy, such as Hf, the Hf may not be fully incorporated into the substrate during diffusion heat treatment. Special precautions such as using a dry box with high purity argon during the preparation of the alloy mixture, pressing the alloy mixture into a compact, or performing the alloying in extremely air-tight furnace that eliminates traces of oxygen during the alloying process have been shown to be beneficial in producing alloy powders containing Pt, Si, and Hf. Additionally, a stepped heat treatment used during alloying is useful in producing a homogenous alloy.

In one embodiment, to provide a Pt-group-metal modified γ-γ' alloy in first layer 616, the solids in suspension 606 may include about 84 wt. % to about 93 wt. % Pt-group metal, about 3 wt. % to about 12 wt. % Si, and about 2 wt. % to about 6 wt. % of the at least one reactive element, based on the total weight of solids in suspension 606.

The total solids content in suspension 606 may be about 15 grams solids per liter liquid carrier to about 40 grams solids per liter liquid carrier, preferably about 30 grams solids per liter liquid carrier.

The liquid carrier in suspension 606 may vary widely so long as it has compatibility with the solids therein, and a variety of organic solvents may be used. The liquid carrier may be essentially anhydrous, i.e., may be essentially free of water. Preferred liquid carriers also have at least one of a high specific gravity and a high dielectric constant. Preferred liquid carriers also dissolve an electrophoretically active agent up to a concentration of about 5 g/L. Additionally, preferred liquid carriers do not react with an activating agent such as those described in further detail below.

In one embodiment useful for making γ-Ni+γ'-$Ni_3Al$ alloys, the liquid carrier may include about 55 wt. % to about 65 wt. % isopropanol and about 35 wt. % nitromethane to about 45 wt. % nitromethane, more preferably about 60 wt. % isopropanol and about 40 wt. % nitromethane.

Suspension 606 may further include an electrophoretically active agent such as zein, gliadin, synthetic methyl cellulose, and the like. The electrophoretically active agent, in conjunction with an activating agent, may form a chelated complex with the metals in suspension 606 that has a positive charge. The electrophoretically active agent may be present in suspension 606 at about 1 g/L to about 3 g/L, more preferably about 2.2 g/L.

Suspension 606 may further include an activating agent. Suitable activating agents include transition metal nitrates having divalent (+2) charges that can form a chelated complex with the electrophoretically active agent. In some embodiments, the activating agents may include nickel nitrate hexahydrate, cobalt nitrate hexahydrate, and the like. The activating agent may be present in the suspension at a concentration from about 0.08 g/L to about 0.20 g/L, and a concentration of about 0.14 g/L is suitable.

The chelated complex formed by the electrophoretically active agent and the activating agent may surround the metal particles in suspension 606 and impart a slight positive charge that causes the encased particle to migrate to and deposit on the negatively charged turbine blade 602 (i.e., the cathode).

In some embodiments, electrophoretic deposition of the Pt-group metal, reactive element, and Si may be carried out for up to about 6 minutes at a current density of about 1 to about 2 $mA/cm^2$ between the anode and cathode (turbine blade 602). Suitable voltages may range from about 35 V to about 250 V, and may be chosen to provide the desired current density. The necessary voltage may be influenced by the composition of electrophoretic bath 608 and the distance between the anode and cathode (turbine blade 602). The suspension may be maintained by mechanical agitation including, for example, an impeller 610, as describe above. Further details regarding electrophoretic deposition processes are provided in U.S. Pats. No. 5,057,196 and 5,958,204 both to Creech et. al, which are incorporated herein by reference in their entirety. The weight of first layer 616 deposited on the exterior surface of turbine blade 602 may range from about 5 mg/cm$^2$ to about 30 mg/cm$^2$, preferably about 10 mg/cm$^2$ to about 20 mg/cm$^2$.

After completion of the electrophoretic deposition of the Pt-group metal, Si and at least one reactive element, turbine blade 602 including first layer 616 is removed from electrophoretic bath 608. Turbine blade 602 coated with first layer 616 may then be subjected to a heat treatment step (not shown). The heat treatment enables the Pt-group metal, Si, and at least one reactive element present in layer 616 to diffuse into the substrate and the substrate elements to diffuse into the first layer 616. The heat treatment step may be performed at temperatures ranging from about 1800° F. to about 2200° F. for about 15 minutes up to about 1 hour. Preferably, the diffusion heat treatment step occurs in an inert atmosphere, such as under a vacuum.

Following the heat treatment step, first layer 616 may include less than about 30 at. % of the Pt-group metal, less than about 2 at. % of the reactive element, and less than about 28 at. % Si. In some embodiments, first layer 616 may include about 10 at. % to about 30 at. % of the Pt-group metal, about 0.3 at. % to about 2 at. % of the reactive element, and about 2 at. % to about 28 at. % Si. In some embodiments, first layer 616 may also include less than about 20 at. % Al, less than about 8 at. % Cr, and less than about 8 at. % Co as a result of diffusion from turbine blade 602, as well as Ni and other superalloy substituents. In some embodiments, first layer 616 may include about 10 at. % to about 20 at. % Al, about 2 at. % to about 8 at. % Cr, and about 4 at. % to about 8 at. % Co. All of the above values are nominal, and may vary up to about ±1-2 at. %.

As an example, in one embodiment, the diffusion heat treatment may result in a coating including about 13 at. % Al, about 25 at. % Pt, about 5 at. % Si, about 1.5 at. % Hf, about 4 at. % Cr, about 6 at. % Co, incidental amounts of other superalloy substrate elements, and the balance Ni. In the same example, the phase constitution of the resulting coating was about 85% $\gamma'$-$Ni_3Al$ and about 15% $\gamma$-Ni.

Figure 9:
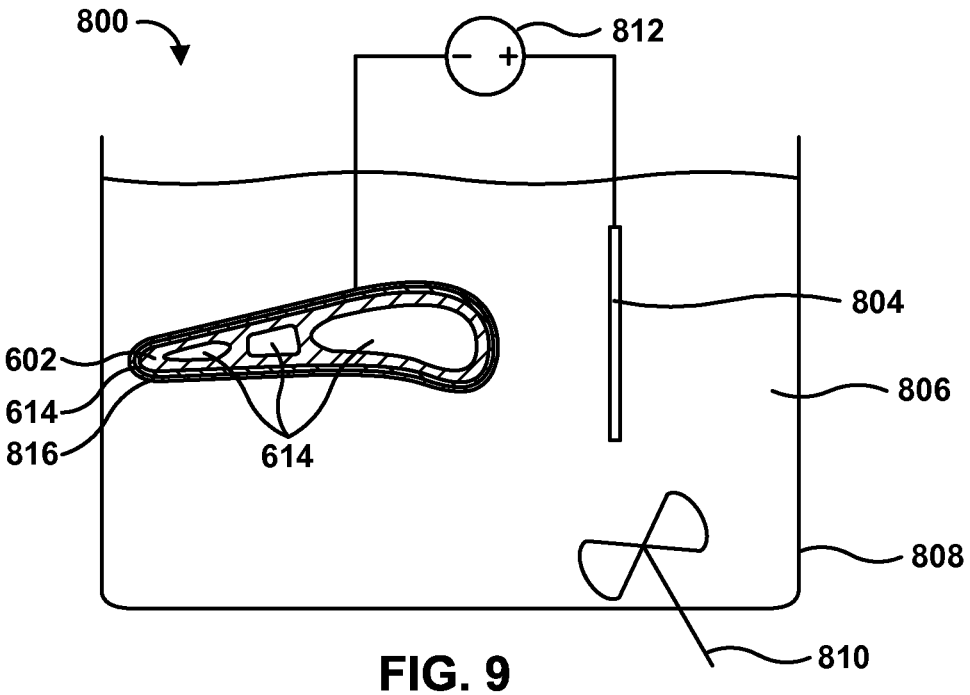
FIG. 9 is a side view illustrating an example article immersed in an electrophoretic bath coated with a first layer including a Pt-group metal, a reactive element, and Si, and a second layer including Al.

A second layer 816 of the external coating may then be deposited on first layer 616 (504), as illustrated in FIG. 9. In some embodiments, second layer 816 may include aluminum (504). Second layer 816 may increase the amount of aluminum present in the final external coating. The Al deposition may be accomplished using any conventional coating technique, including pack cementation. When pack cementation is utilized, turbine blade 602 including first layer 616 is buried in a ceramic boat by a powder pack including the composition to be deposited.

Coating thickness and composition may be controlled by selecting appropriate pack cementation times and temperatures, and by controlling the composition of the pack. In some embodiments, the pack may include about 0.5 wt. % to about 1 wt. % Al, about 1 wt. % to about 5 wt. % organo halocarbon powder, and the balance 90 grit aluminum oxide.

Turbine blade 602 including first layer 616 and the pack are then heated to a temperature between about 1400° F. to about 1975° F. for about 1 hour to about 4 hours, which causes the coating materials in the pack to deposit on to first layer 616.

Additionally, one or more reactive elements may be included in the pack mixture in amounts up to about 5 wt. %, if desired. The inclusion of one or more reactive element in second layer 816 may increase the concentration of the one or more reactive element in the final external coating.

Figure 8:
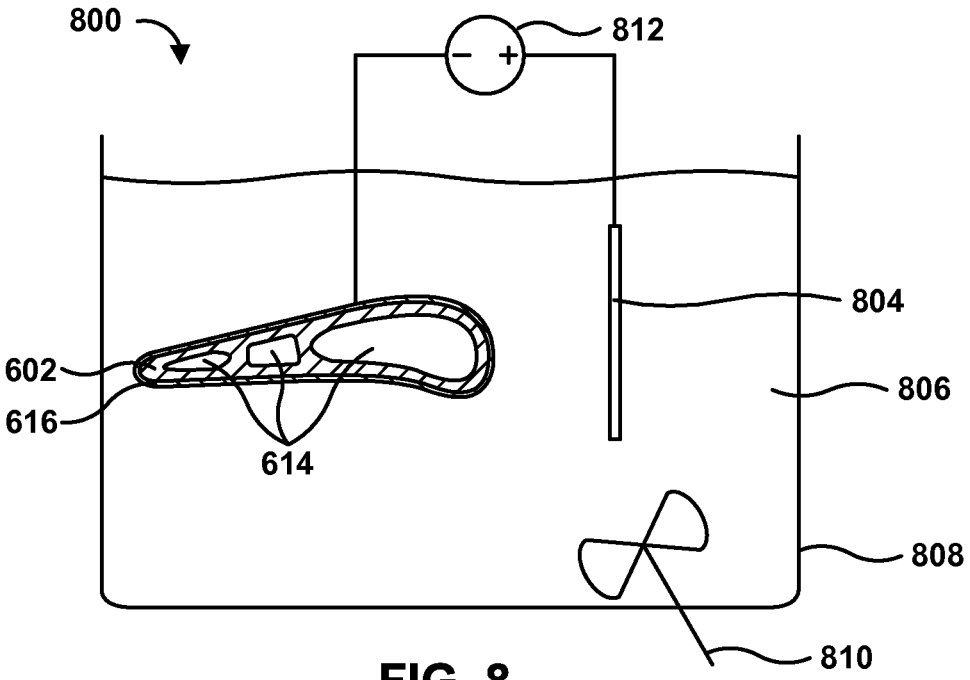
FIG. 8 is a side view illustrating an example article coated with a layer including a Pt-group metal, a reactive element, and Si immersed in a second electrophoretic bath.

Alternatively, the deposition of second layer 816 may be accomplished using a second electrophoretic deposition system 800, as illustrated in FIGS. 8 and 9. Similar to FIG. 6, an electrophoretic bath 808 is prepared which includes a suspension 806 that may include a second coating composition, solvent or liquid carrier, and any necessary additives, such as activators and the like. An impeller 810 or other suitable agitator may agitate suspension 806 to keep the second coating composition and additives in suspension. Turbine blade 602 including first layer 616 is electrically coupled to a DC voltage source 812 as a cathode, and another conductive material 804 is connected to DC voltage source 812 as an anode. Turbine blade 602 including first layer 616 and conductive material 804 are submerged in suspension 806, and the DC voltage source 812 applied a voltage difference between turbine blade 602/first layer 616 and conductive material 804, causing a current to flow, and a positively-charged metal chelated complex second coating composition to deposit on the negatively charged first layer 616.

The electrophoretic suspension 806 may include solids, a liquid carrier, and any necessary additives, such as activators and the like.

Suitable liquid carriers include nitroalkanes, alcohols containing about 1 to about 6 backbone carbons, glycols, and the like, and mixtures of isopropanol and nitromethane are preferred. In some embodiments, the liquid carrier comprises about 55 wt. % to about 65 wt. % isopropanol and about 35 wt. % to about 45 wt. % nitromethane, and may include about 60 wt. % isopropanol and about 40 wt. % nitromethane.

Electrophoretic suspension 806 may further include an activating agent and an electrophoretically active agent, including those described above. Suitable electrophoretically active agents include zein, and electrophoretic suspension 806 may include about 1 g/L to about 3 g/L, preferably about 2.2 g/L. Suitable activating agents include cobalt nitrate hexahydrate, and electrophoretic suspension 806 may include an activating agent concentration of about 0.08 g/L to about 0.20 g/L. In some embodiments, electrophoretic suspension 806 may include an activating agent concentration of about 0.14 g/L.

The electrophoretically active agent and the activating agent may form a chelated complex which may surround the metal particles in the electrophoretic suspension 806 and impart a slight positive charge that causes the encased particle to migrate to and deposit on the negatively charged cathode (turbine blade 602/first layer 616).

The solids present in electrophoretic suspension 806 may include an Al source, an organo halocarbon activator, and filler. In some embodiments, electrophoretic suspension 806 may include a total solids content (including the coating composition) of about 15 g solids per L liquid carrier to about 40 g solids per L liquid carrier, preferably about 30 g solids per L liquid carrier.

Based on presently available evidence, the organo halocarbon can act as an activator for the Al. The use of the organo halocarbon activator is particularly preferred for the electrophoretic deposition process, as conventional halide salt activators are not compatible with this process, but may also be used for pack cementation.

Suitable organo halocarbons include, for example, fluoropolymers, such as polytetrafluoroethylene (PTFE), chloropolymers, such as polyvinylchloride (PVC), and the like.

Suitable organo halocarbons can preferably be produced in granular form and are compatible with the liquid carrier in the electrophoretic suspension 806. One particularly preferred fluoropolymer is polytetrafluoroethylene (PTFE), which may be obtained from DuPont Fluoroproducts, Wilmington, Del., under the trade designation DuPont Teflon PTFE 60, and the trade designation Dupont Zonyl MP-1200.

During the electrophoretic process, the organo halocarbon and Al are substantially concurrently deposited on first layer 616, forming second layer 816, as shown in FIG. 9.

The Al source may include elemental Al, or may include alloy powders such as, for example (by weight) 55Al:45Cr, 42Al:40Cr:18Mn, 70Al:30Cr, other aluminum-chromium alloys, organo-aluminum compounds, and the like.

The filler may be a non-reactive oxide powder, such as aluminum oxide, zirconium oxide, titanium oxide, or hafnium oxide, and the like. The solids in electrophoretic suspension 806 may include about 0.5 wt. % to about 25 wt. % of the Al source, about 1 wt. % to about 10 wt. % of the organo halocarbon activator, and the balance filler.

Electrophoretic deposition of the Al may be carried out for up to about 6 minutes at a current density of about 1 mA/cm$^2$ to about 2 mA/cm$^2$ between the anode and cathode (article 402/first layer 414). Suitable voltages may range from about 35 V to about 250 V, and may be chosen to provide the desired current density. The necessary voltage may be influenced by the composition of electrophoretic bath 808 and the distance between the anode and cathode (turbine blade 602/first layer 616). The suspension may maintained by mechanical agitation including, for example, an impeller 810, as described above. Further details regarding electrophoretic deposition processes are provided in U.S. Pat. Nos. 5,057,196 and 5,958,204 both to Creech et al., which are incorporated herein by reference in their entirety. Adjusting either the current density or deposition time, or both, may allow control over the green coat weight. The green coat weight is the weight of second layer 816 applied to first layer 616 per unit area of first layer 616, and green coat weight affects the total amount of Al available to diffuse into the coating during subsequent heat treatment steps. Preferred green coat weights range from about 12 mg/cm$^2$ to about 65 mg/cm$^2$, preferably about 15 mg/cm$^2$ to about 30 mg/cm$^2$.

After application of the second layer 816, a mixture (e.g., mixture 404) may be introduced into cavities 614 of turbine blade 602 (204) and turbine blade 602 and mixture 404 may be heated to activate mixture 404 (206), as described above in further detail with reference to FIGS. 2, 3, 4A and 4B. While not wishing to be bound by any theory, presently available evidence indicates that the heat treatment may cause the organo halocarbon activator to decompose, releasing halogens, which may then react with the aluminum in the aluminum source, activating the aluminum. When the aluminum halide compound diffuses to the surface cavities 614, the aluminum reacts with and is bound to the surface. The reaction of aluminum with the surface liberates the halide, which is then free to react with and activate another aluminum atom in the mixture.

The heating of turbine blade 602 and mixture 404 may substantially simultaneously activate the aluminum present in second layer 816. For example, the heat treatment may cause the organo halocarbon activator to decompose and release halogens, which react with the aluminum in the second layer 816 to form an aluminum halide. The aluminum halide may diffuse to the surface of first layer 616 and the aluminum may react with and be bound to the surface of first layer 616. Further, the heat treatment step (206) may facilitate interdiffusion between turbine blade 602, first layer 616 and second layer 816.

As described above, heating of turbine blade 602 and mixture 404 may occur at a temperature of about 1400° F. to about 1975° F. for about 1 hour to about 4 hours. In some embodiments, the heat treatment may be carrier out in an oven under an inert atmosphere, such as a partial pressure (e.g., about −5 inches Hg) of argon. The heat treatment may also result in thermal decomposition and removal of any masking material 402.

After heating the turbine blade 602 and mixture 404, the exterior surface of turbine blade 602 may optionally be cleaned to remove any excess green coat that is not chemically bound to the exterior surface of turbine blade 602. Cleaning may be accomplished by ultrasonic cleaning in water or a solvent such as methanol, or simply mechanically removing the residual unreacted bisque with a soft bristle brush, or the like. For example, the exterior surface of turbine blade 602 may be ultrasonically cleaned twice in methanol for about 5 minutes.

The turbine blade 602 and mixture 404 may then undergo a final heat treatment (506). The final heat treatment facilitates further diffusion of the coating elements and produces a more uniform coating. The final heat treatment step is preferably carried out at about 1975° F. to about 2080° F. for about 1 to about 4 hours, although any convenient temperature may be used.

Following the final heat treatment, cavities 614 may optionally be cleaned to remove any excess mixture 404. For example, in some embodiments a high pressure water blast may be used to remove any remaining residue.

While the technique illustrated in FIG. 5 has been described with the steps technique occurring in one order, the steps of the technique may be performed in other orders. For example, in some embodiments, the mixture may be introduced into the cavity (204) prior to deposition of the second layer of the external coating (504).

EXAMPLES

Example 1

A turbine blade having a part number 23072440 was electrophoretically coated with a PtSiHf alloy including about 91.6 wt. % Pt, about 3.5 wt. % Si and about 4.8 wt. % Hf and diffused at 2175° F. for 15 minutes in a vacuum. The heat treatment in vacuum may also result in vacuum cleaned surfaces of the internal cavities of the blade. After a light 220 grit blast with aluminum oxide at about 20 to 25 psi, a deposit of approximately 6 wt. % aluminum, 3.5 wt. % polytetrafluoroethylene and the balance 1 micron aluminum oxide filler (XP-101) was electrophoretically applied to the external surfaces according to a method described in U.S. patent application Ser. No. 11/963,249. After the electrophoretic deposition, a composition including approximately 6 wt. % aluminum, 3.5 wt. % polytetrafluoroethylene and the balance 1 micron aluminum oxide filler was mixed with zein in a 60 wt. % isopropanol and 40 wt. % nitromethane vehicle in the approximate ratio of 100 grams of solids to 50 milliliters of zein solution. The composition was injected into the internal cavity of the turbine blade until the slurry composition exited the trailing edge opening and film cooling holes at the tip of the blade. The two holes on the bottom of the blade dovetail were filled with Dymax 706-H (available from DYMAX Corporation, Torrington, Conn.) and cured for approximately 5 minutes under an ultraviolet light to harden the plugs.

The composition was activated by a heat treatment at 1500° F. for about 1 hour under a −5" Hg partial pressure of argon gas. Upon completion of the heat treatment, undiffused bisque left on the external surfaces of the blade was removed by vigorous brushing with a soft bristle brush. Following this, the blade was placed in a beaker containing methanol and ultrasonically cleaned for about 5 minutes. The ultrasonic cleaning was repeated in fresh methanol for about 5 minutes.

The coating was further heat treated at about 2080° F. for about 1 hour in a vacuum at approximately $10^{-4}$ Torr to form the external PtAl coating and the internal aluminide coating.

Figure 10A:
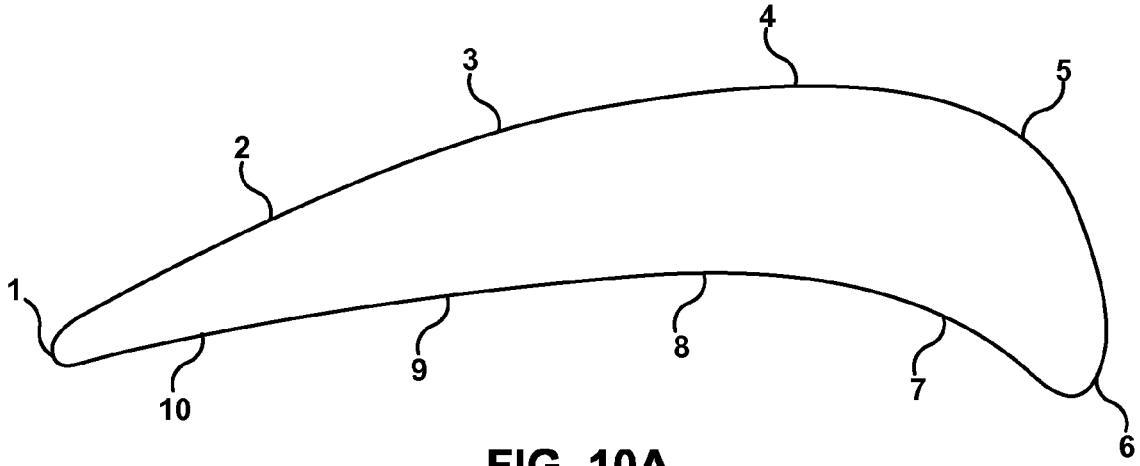
FIGS. 10A and 10B are cross-sectional diagrams that depict locations of a gas turbine blade at which coating thicknesses were measured for Table 1.
Figure 10B:
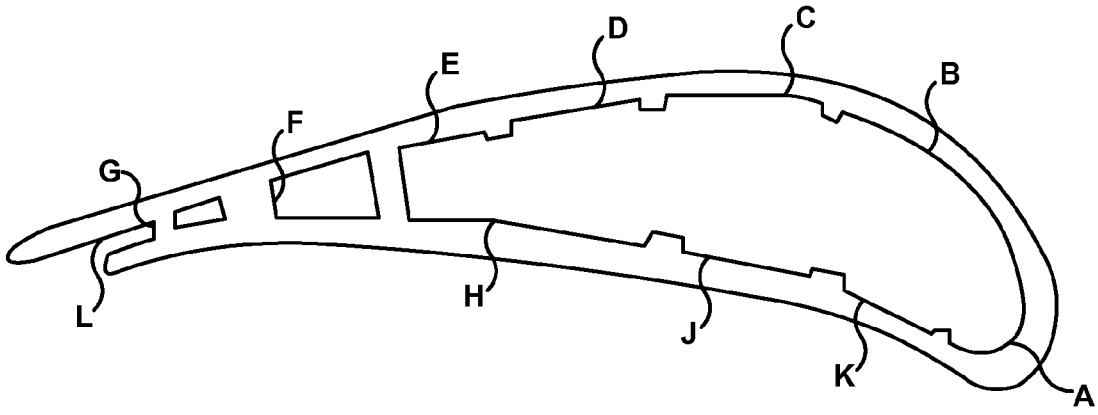

After the post-coat heat treatment, the blade was heat tinted to demonstrate complete coating coverage on the external surfaces. The heat-tinted blade showed the dovetail serrations were free of coating per the design of the Dymax 706-H masking plugs in the bottom two holes of the blade stalk. A high pressure water blast was used to remove any remaining residue from the internal cavity of the blade. The blade was sectioned at approximately 15%, 50% and 85% of the length of the blade to document the coating thicknesses on the internal surfaces of the blade. Table 1 shows the coating thicknesses on the external and internal surfaces produced by this method, and FIGS. 10A and 10B illustrate the locations at which the thickness measurements were collected.

TABLE 1

| External Coating Thickness (mils) | | | | | | | | | |
|---|---|---|---|---|---|---|---|---|---|
| 1 | 2 | 3 | 4 | 5 | 6 | 7 | 8 | 9 | 10 |
| 3.01 | 1.70 | 1.96 | 2.11 | 2.32 | 2.24 | 1.76 | 1.70 | 1.81 | 1.85 |
| Internal Coating Thickness (mils) | | | | | | | | | |
| A | B | C | D | E | F | G | H | J | K | L |
| 0.62 | 0.76 | 0.63 | 0.60 | 0.76 | 0.55 | 0.53 | 0.61 | 0.72 | 0.60 | 0.40 |

Example 2

A turbine blade having part number 23072440 was subjected to "pickling" for 30 minutes in a 50% nitric acid and 50% water solution at approximately 150° F. to clean the internal surfaces of the blade in preparation for the internal coating. The blade was coated with the same PtSiHf alloy as described in Example 1 and diffused at 2175° F. for 15 minutes in a vacuum. After a light grit blast, the blade was masked by filling the trailing edge and film cooling holes near the blade tip with Testors cement (available from The Testor Corporation, Rockford, Ill.). The excess Testors cement was wiped off prior to curing and lightly grit blasted with 220 grit aluminum oxide after curing to remove any excess. In this example, the surfaces just inside the trailing edge and the inside surfaces of the film cooling holes thus have thin or no coating.

With the masking in place, a dry pack mix consisting of approximately 1 wt. % aluminum, 1 wt. % fine polytetrafluoroethylene powder and the balance 90 grit aluminum oxide was poured into the blade cavity and vibrated until the dry pack mix was near the top of the two holes in the bottom of the blade dovetail. As in Example 1, Dymax 706-H was injected into the two holes to seal off the internal cavity and prevent gaseous aluminum-containing species from depositing aluminide coating on the machined dovetail surface of the blade during heat treatment. As before, the Dymax 706-H was cured with ultraviolet radiation.

Following this, the XP-101 coating was electrophoretically deposited onto the external surfaces of the blade. Initial diffusion of the Al-containing external and internal coatings was performed at a temperature of about 1500° F. for about 1 hour under a −5" Hg partial pressure of argon. After brushing off the residual undiffused bisque from the external surfaces and ultrasonically cleaning the exterior surfaces in methanol twice, as in Example 1, the blade was subjected to the same post-coat heat treatment of about 2080° F. for about 1 hour in a vacuum oven at approximately $10^{-4}$ Torr.

Figure 11A:
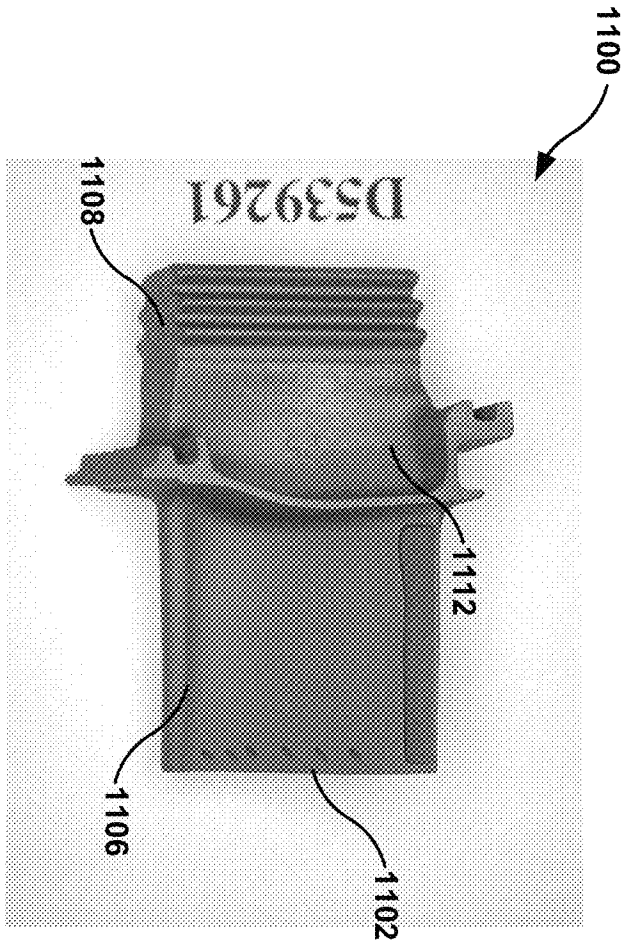
FIGS. 11A and 11B depict a heat tinted turbine blade.
Figure 11B:
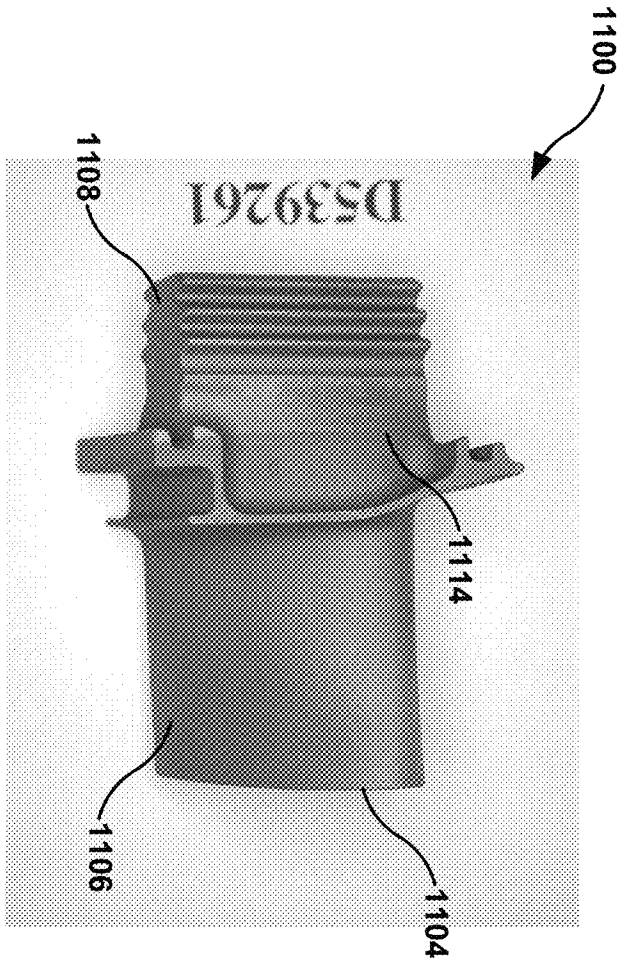
Figure 12:
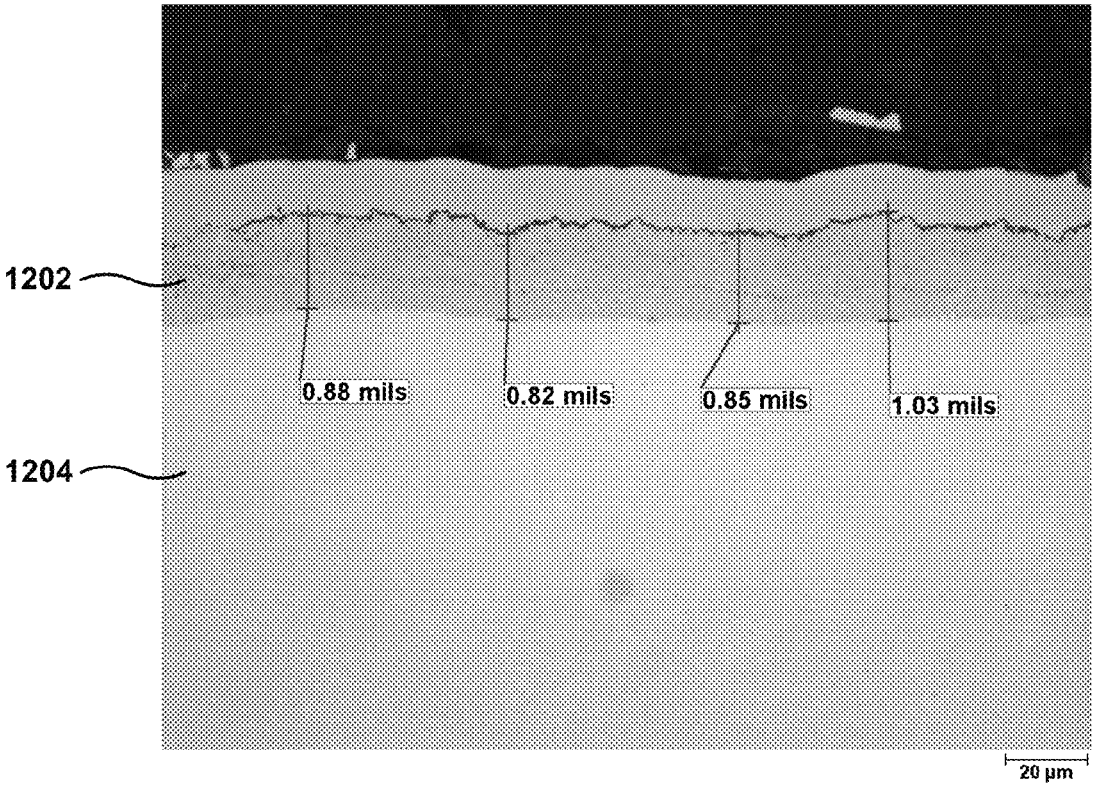
FIG. 12 is a cross sectional view of an example coating, which shows the microstructure of an aluminide coating on a surface of a cavity.

FIGS. 11A and 11B show photographs of a concave side 1102 and convex side 1104, respectively of blade 1100 after heat tint, and show an external coating 1106 on blade 1100 and absence of coating 1108 on the stalk surfaces 1110. Reference numerals 1112 and 1114 indicate the FIG. 12 shows a typical microstructure of an aluminide coating 1202 on an internal surface 1204 of a blade. As shown, the aluminide coating ranges in thickness from about 0.82 mils to about 1.03 mils.

Various embodiments of the invention have been described. These and other embodiments are within the scope of the following claims.

The invention claimed is:

1. A method comprising:

introducing a mixture comprising an aluminum source and an organo halocarbon activator into an internal cavity of an article; and heating the article and the mixture to a temperature sufficient to form an aluminum halide, which deposits on a surface of the internal cavity to form a coated article.

2. The method of claim 1, further comprising:

depositing on an external surface of the article a first layer comprising Pt, Si, and a reactive element selected from the group consisting of Hf, Y, La, Ce, Zr, and combinations thereof; and depositing a second layer comprising Al on the first layer to form an alloy including a —Ni+γ'-$Ni_3Al$ phase constitution, wherein the second layer is deposited with the organo halocarbon activator.

3. The method of claim 2, wherein depositing the second layer comprising Al comprises electrophoretically depositing the second layer comprising Al.

4. The method of claim 2, wherein heating the article and mixture comprises heating the article, mixture, first layer and second layer to a temperature sufficient to form an aluminum halide from the aluminum source and the organo halocarbon activator in the mixture and from the Al and the organo halocarbon activator in the second layer.

5. The method of claim 1, further comprising preparing the surface of the internal cavity prior to introducing the mixture.

6. The method of claim 1, further comprising masking at least one of a film cooling hole and a trailing edge exit slot with a masking material prior to introducing the mixture.

7. The method of claim 6, wherein the masking material comprises an aluminum source.

8. The method of claim 1, further comprising masking a metering plate orifice with a masking material after introducing the mixture.

9. The method of claim 8, wherein the masking material comprises an aluminum source.

10. The method of claim 1, further comprising heat treating the coated article.

11. The method of claim 1, wherein the mixture comprises a dry slurry including aluminum, the organo halocarbon activator and a filler.

12. The method of claim 11, wherein the dry slurry comprises about 0.5 wt. % to about 25 wt. % of the aluminum source and about 1 wt. % to about 10 wt. % of the organo halocarbon activator.

13. The method of claim 11, wherein the filler comprises a particle size of about 1 micron to about 160 microns.

14. The method of claim 13, wherein the filler comprises a particle size of about 90 microns to about 160 microns.

15. The method of claim 1, wherein the mixture comprises a wet slurry including aluminum and the organo halocarbon activator in a liquid carrier.

16. The method of claim 15, wherein the wet slurry comprises solids including about 0.5 wt. % to about 25 wt. % of the aluminum source and about 1 wt. % to about 10 wt. % of the organo halocarbon activator.

17. The method of claim 1, wherein the aluminum source comprises at least one of elemental aluminum, an aluminum-chromium alloy, an organo-aluminum compound, or an aluminum-chromium-manganese alloy.

18. The method of claim 1, wherein the organo halocarbon activator comprises at least one of a fluoropolymer and a chloropolymer.

19. The method of claim 1, wherein the organo halocarbon activator comprises polytetrafluoroethylene.

20. The method of claim 1, wherein heating the article and mixture comprises heating the article and mixture to a temperature of about 1400° F. to about 1975° F.

21. The method of claim 20, wherein heating the article and mixture to a temperature of about 1400° F. to about 1975° F. comprises heating the article and mixture to a temperature of about 1500° F.

22. A method comprising:

depositing on an external surface of an article a first layer comprising Pt, Si, and a reactive element selected from the group consisting of Hf, Y, La, Ce, Zr, and combinations thereof;

introducing a mixture comprising aluminum and an organo halocarbon activator into an internal cavity of the article; and depositing a second layer comprising Al on the first layer to form an alloy including a —Ni+γ'-$Ni_3Al$ phase constitution, wherein the second layer is deposited with the organo halocarbon activator.

23. The method of claim 22, wherein depositing the second layer comprising Al comprises electrophoretically depositing the second layer comprising Al.

24. The method of claim 23, wherein the second layer is deposited from an electrophoretic suspension comprising solids including about 0.5 wt. % to about 25 wt. % of an Al source, about 1 wt. % to about 10 wt. % of an organo halocarbon activator, and a filler.

25. The method of claim 22, further comprising preparing the surface of the internal cavity prior to introducing the mixture.

26. The method of claim 22, further comprising masking at least one of a film cooling hole and a trailing edge exit slot with a masking material prior to introducing the mixture.

27. The method of claim 26, wherein the masking material comprises an aluminum source.

28. The method of claim 22, further comprising masking a metering plate orifice with a masking material after introducing the mixture.

29. The method of claim 28, wherein the masking material comprises an aluminum source.

30. The method of claim 22, further comprising heat treating the article.

31. The method of claim 22, wherein the mixture comprises a dry slurry including aluminum, the organo halocarbon activator and a filler.

32. The method of claim 22, wherein the mixture comprises a wet slurry including aluminum and the organo halocarbon activator in a liquid carrier.

33. The method of claim 22, wherein the organo halocarbon activator comprises polytetrafluoroethylene.

34. The method of claim 22, further comprising:

heating the article and mixture to about 1400° F. to about 1975° F. to form an aluminum halide, which deposits on a surface of the internal cavity to form a coated article.

35. The method of claim 34, wherein heating the article and mixture to about 1400° F. to about 1975° F. comprises heating the article and mixture to about 1500° F.

36. The method of claim 1, wherein the mixture comprises 0.5 wt % to 25 wt % of an Al source and 1 wt % to 10 wt % of an organo halocarbon activator selected from at least one of a fluoropolymer and a chloropolymer.

* * * * *